United States Patent [19]

Busch

[11] 3,967,550

[45] July 6, 1976

[54] SQUEEZE PRINTER FOR PAPERS OR STACKS OF PAPERS OF VARYING THICKNESSES

[75] Inventor: Richard E. Busch, La Puente, Calif.

[73] Assignee: Addmaster Corporation, San Gabriel, Calif.

[22] Filed: July 25, 1974

[21] Appl. No.: 491,871

[52] U.S. Cl. ..... 101/93.18; 101/93.22; 101/93.41; 101/110

[51] Int. Cl.[2] ..... B41J 1/22

[58] Field of Search ..... 197/49, 51, 144–149; 101/110, 109, 91, 93.18, 93.35, 93.36, 93.41, 99, 95, 93.22; 178/34, 35; 235/60.28

[56] References Cited

UNITED STATES PATENTS

| | | | |
|---|---|---|---|
| 3,217,639 | 11/1965 | Kelly | 101/91 X |
| 3,381,790 | 5/1968 | Chaveneaud et al. | 101/110 X |
| 3,418,933 | 12/1969 | Schaefer | 197/51 X |
| 3,461,797 | 8/1969 | Trab et al. | 101/91 X |
| 3,618,513 | 11/1971 | Merker | 101/109 X |
| 3,664,259 | 5/1972 | Weinkle | 101/99 |
| 3,712,211 | 1/1973 | Thut | 101/93.36 |

*Primary Examiner*—Ralph T. Rader
*Attorney, Agent, or Firm*—Fred N. Schwend

[57] ABSTRACT

A squeeze type printer for papers or stacks of papers having varying thicknesses wherein a printing platen is advanced to impress the paper against type bearing members by a yieldably driven cam element connected in series with a positively driven cam element. The yieldably driven cam element is self-locking and acts to advance the paper or paper stack against the type bearing member. Concurrently, the positively driven cam element acts to further advance the paper to cause the printing impression.

9 Claims, 15 Drawing Figures

FIG. 1.
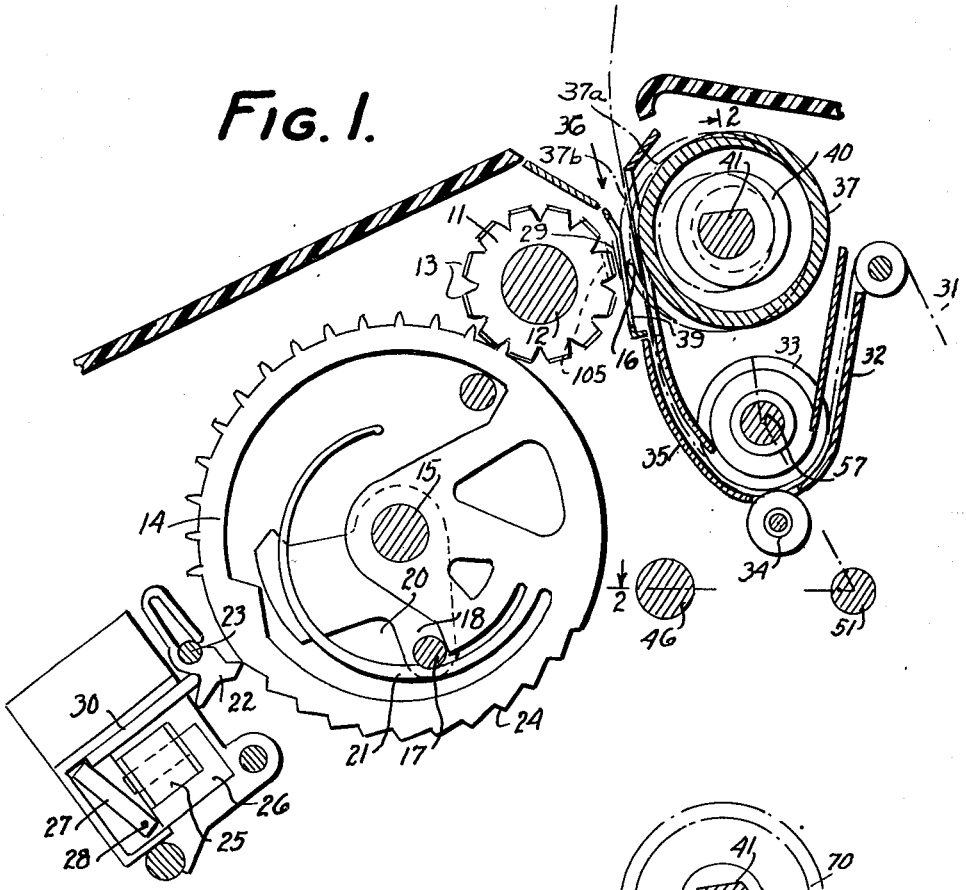
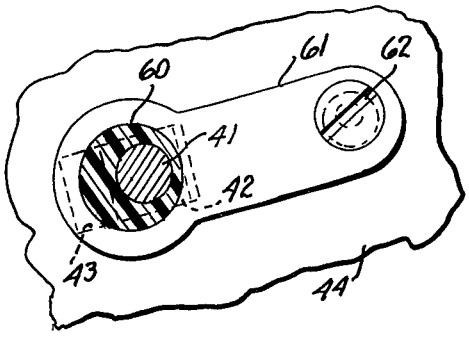
FIG. 3.
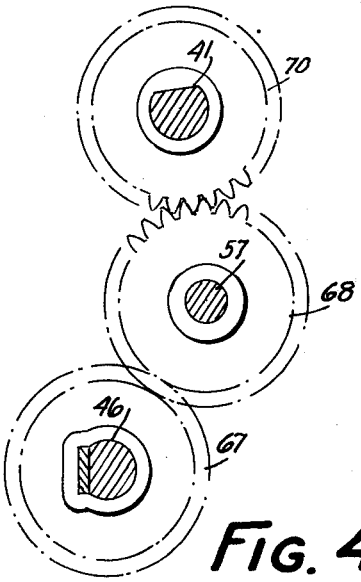
FIG. 4.
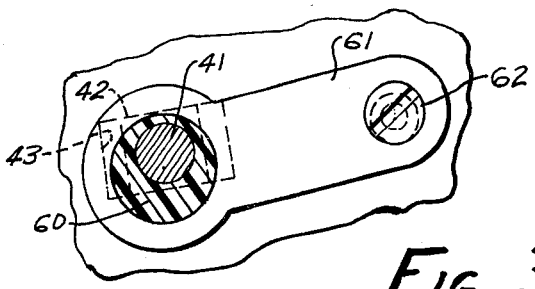
FIG. 3A

FIG. 6.
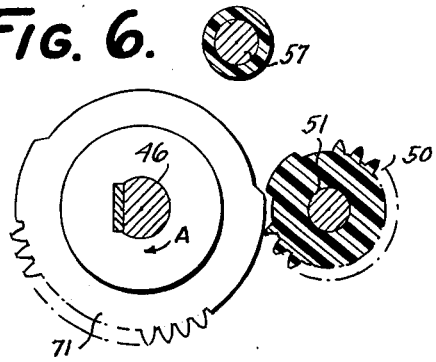
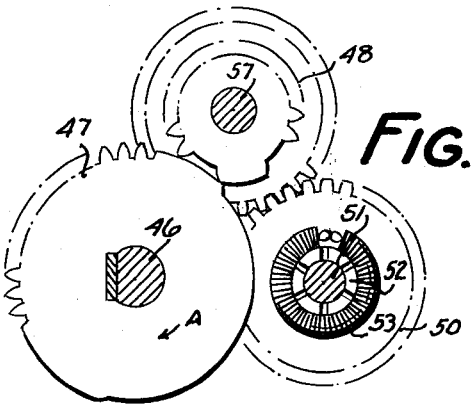
FIG. 7.
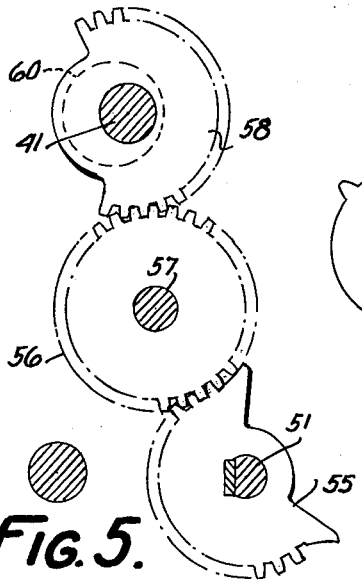
FIG. 5.
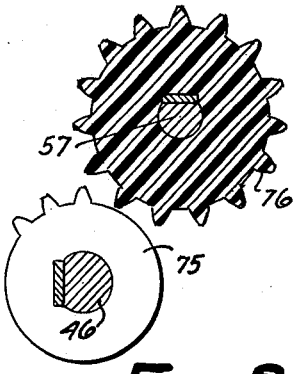
FIG. 8.
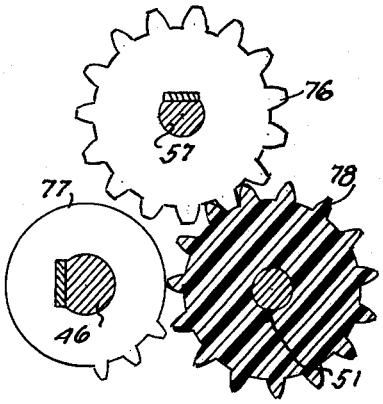
FIG. 9.
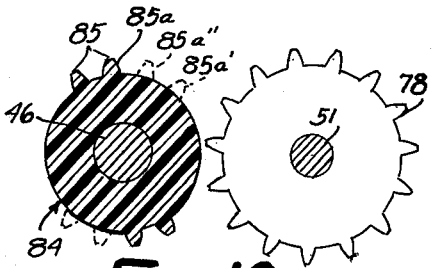
FIG. 10.
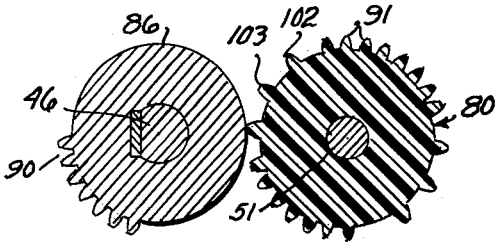
FIG. 12.
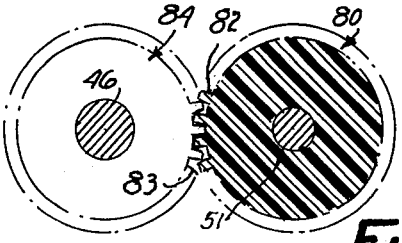
FIG. 11.
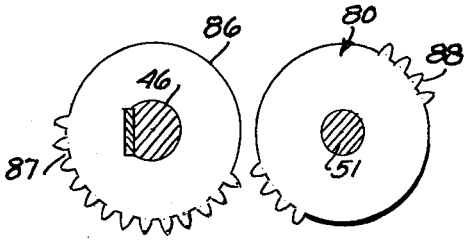
FIG. 13.

SQUEEZE PRINTER FOR PAPERS OR STACKS OF PAPERS OF VARYING THICKNESSES

BACKGROUND OF THE INVENTION

1. Field of the Invention

This invention relates to data printers and has particular reference to printers for printing stacks of papers, paper forms or the like of varying thicknesses.

2. Description of the Prior Art

Printers of the above type have been employed heretofore and are generally of the impact type wherein type hammers or type bearing members are spring impelled against the paper to effect an imprint. In such cases, the thickness of the paper stack has little effect on the quality of the printing impression on the outermost paper or surface. In cases where interleafed carbon papers are required to provide multiple copies, it has been general practice to adjust the tension of the hammer impelling springs in accordance with such number of copies. That is, in those cases where a large number of superimposed copies are to be printed, the spring tension is increased. This is normally effected as an adjustment prior to the printing operation.

Although impact printers of the above type are generally satisfactory, they are obviously noisy in operation.

Squeeze type printers, which are inherently quieter than impact printers, have also been used heretofore. In such printer, a platen or a type of bearing member is forced, at a controlled rate of movement, against the paper to effect an imprint. Such printers must exert considerable pressure during imprinting operations and are generally operated by cams, toggles or levers which have a definite throw and therefore can not accomodate widely different thicknesses of paper stacks. Accordingly, the quality of impression varies considerably with the thickness of such paper stacks.

Accordingly, a principal object of the present invention is to provide a data printer of the squeeze type capable of accomodating various thicknesses of stacks of papers to be printed.

Another object is to provide a data printer of the above type which automatically adjusts the throw of the platen in accordance with the thickness of the paper stack to be printed.

A further object is to provide a data printer of the above type which is reliable and economically manufactured.

SUMMARY OF THE INVENTION

According to the basic aspect of the present invention, a wedging or camming device is yieldably actuated to advance a printing platen so as to move the paper or paper stack to be printed into intimate contact with a type bearing member or members. Concurrently, a positive acting device additionally advances the platen a predetermined fixed amount to effect the actual printing impression. The wedging or camming device is self-locking so that it can not be retracted or returned from its advanced position by the positive acting means. Thus, an accurate printing impression is automatically obtained regardless of the thickness of the paper or paper stack.

Since both the yieldable means and the positive acting means operate concurrently, in those cases where a thick stack of paper is to be printed, the yieldable means will be arrested earlier in its stroke. Accordingly, the positive acting means will continue through a relatively greater length of its stroke to compress the paper stack during the imprinting operation so as to obtain substantially the same quality of impression as is obtained in those cases where only one or two papers are imprinted. In the latter case, the yieldable means will engage the paper later in its stroke and thus the positive acting means will likewise have moved through a relatively greater length of its stroke before effecting the printing impression.

BRIEF DESCRIPTION OF THE DRAWINGS

The manner in which the above and other objects of the invention are accomplished will be readily understood on reference to the following specification when read in conjunction with the accompanying drawings, wherein:

FIG. 1 is a sectional view through a data printer embodying a preferred form of the present invention.

FIG. 3 is a sectional view showing part of the platen shaft shifting mechanism and is taken along the line 3—3 of FIG. 2.

FIG. 3A is a sectional view similar to FIG. 3 but showing the platen shaft as partially advanced toward the type wheels by the yieldably driven eccentrics.

FIG. 4 is a sectional view of the platen shaft rotating mechanism and is taken along line 4—4 of FIG. 2.

FIG. 5 is a sectional view illustrating part of the platen shifting drive mechanism and is taken along line 5—5 of FIG. 2.

FIG. 6 is a sectional view through part of the drive train and is taken substantially along line 6—6 of FIG. 2.

FIG. 7 is a sectional view through another part of the drive train and is taken along the line 7—7 of FIG. 2.

FIG. 8 is a sectional view illustrating the paper roll-back gears and is taken along the line 8—8 of FIG. 2.

FIG. 9 is a sectional view illustrating the paper roll-forward gears and is taken along the line 9—9 of FIG. 2.

FIGS. 10, 11, 12 and 13 are sectional views illustrating the gearing for advancing the paper different increments during each cycle and are taken along respective lines 10—10, 11—11, 12—12 and 13—13 of FIG. 2.

DESCRIPTION OF THE PREFERRED EMBODIMENT

Figure 14:
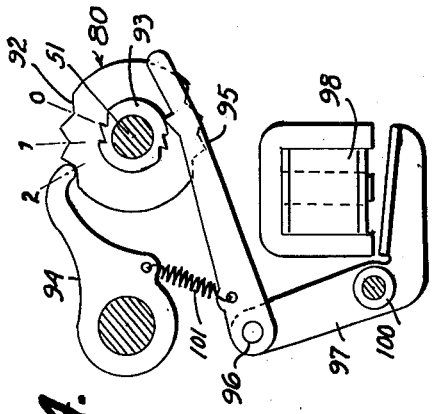
FIG. 14 is a sectional view taken along the line 14—14 of FIG. 2 illustrating the device for preselecting the extent of line feeding of the paper.

Referring in particular to FIG. 1, the printer comprises a plurality of type wheels, one of which is shown at 11, arranged in side-by-side relation for independent rotation on a stationary shaft 12. Twelve type characters 13, including numerical type characters ranging from 0 to 9, are equally spaced about each type wheel 11. Gear tooth spaces are formed on each type wheel intermediate the type characters to mesh with mating teeth on plastic drive sectors, one of which is shown at 14, independently rotated on a rockable shaft 15.

Means are provided to yieldably advance the various sectors 14 clockwise from their illustrated home positions during the first half of a printer cycle until differentially arrested in positions wherein the type wheels 11 present selected type characters 13 along a printing line or station 16. After a printing impression, the sectors 14 are returned counterclockwise to their illustrated positions during the latter half of the printer cycle. For this purpose, a bail rod 17 carried by arms, one of which is shown at 18, fixed to shaft 15 extends through openings 20 in the sectors and frictionally engages spring tails 21 formed integrally with the sectors. During the first half of the cycle, the shaft 15 is rocked clockwise through approximately 130° to yieldably drive the various sectors 14 correspondingly.

Means are provided to selectively arrest the different type sectors in different positions so as to present selected type characters 13 at the printing station. For this purpose, a stop pawl 22 is provided for each sector. The pawls 22 are independently pivoted on a stationary rod 23 and are normally located out of blocking engagement with spaced stop teeth 24 on the sectors 14.

Electromagnetic coils 25 are provided adjacent respective pawls 22. Each coil 25 surrounds one leg of a U-shaped magnet core 26, and upon energization of a coil 25, an armature 27 pivoted at 28 is attracted upwardly by the core 26 and in so doing forces a rod 30 endwise to rock the associated pawl 22 into blocking relation with whichever stop tooth 24 is next adjacent the pawl at the time of energization.

A paper tape 31 is guided from a suitable supply roll (not shown), through a guide chute 32, between a paper feed roller 33 and a pressure roller 34, thence upwardly through a second guide chute 35 and through a printing or validating chute 36. An opening 39 is formed in the rear wall of the chute 36 to permit a platen roll 37 to be moved forwardly, to the left in FIG. 1, to imprint the tape 31 against a suitable printing ribbon 29 and aligned type characters 13 located at the printing station 16.

Stacks of paper slips or other record media of different thicknesses may also be supported in the chute 36 either with or without interleaved carbon papers. Also, a carbon paper may be inserted in front of the tape 31.

Figure 2:
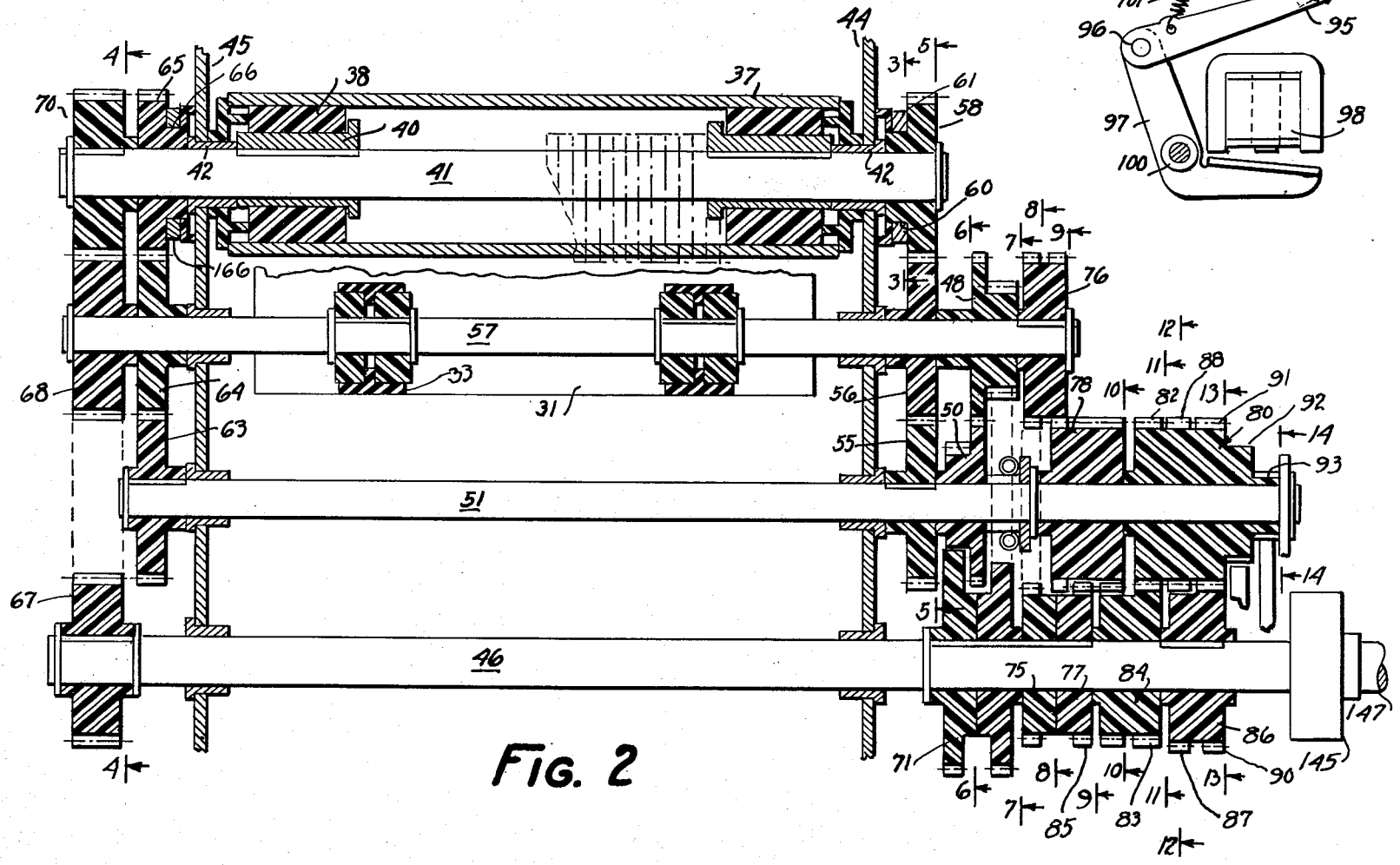
FIG. 2 is a transverse sectional view of the printer and is taken substantially along the folded line 2—2 of FIG. 1.

The platen roll 37, see also FIG. 2, is supported by bearing sleeves 38 rotatably mounted on eccentrics 40 keyed to a platen support shaft 41. The latter is rotatably mounted in slide bearings 42 (see also FIG. 3) slideable toward and away from the type wheels 11 in slide bearings 43 formed in printer side frames 44 and 45.

A drive shaft 46 (FIGS. 2, 6 and 7) is rotatably supported in bearings carried by the side frames 44 and 45 and is rotated through one revolution in the direction of the arrow A during each printing cycle by a motor driven shaft 147 through a cyclic clutch 145 of conventional construction.

During approximately the first 90° of rotation of shaft 46, a gear 47 having a set of interrupted gear teeth thereon meshes with the smaller member of a compound gear 48 having a set of interrupted gear teeth thereon. The larger member of gear 48 meshes with the larger member of a second compound gear 50 mounted on a shaft 51 and yieldably coupled thereto by a friction clutch 52.

The clutch 52 which forms a yieldable drive means comprises a series of segments of 53 integral with gear 50 and held in frictional constricting engagement with the shaft 51 by a spring 54 tensioned therearound. Accordingly, the shaft 51 is yieldably rotated in opposite directions during each printer cycle as will appear later.

A gear 55 (see also FIG. 5) having an interrupted set of gear teeth therearound is entrained through an idler gear 56 freely rotatable on a shaft 57, with a gear 58 freely rotatable on the platen support shaft 41 and having a cam or eccentric 60 formed thereon. The eccentric 60 (see also FIG. 3) is rotatably mounted in a bearing member 61 pivotally supported on an adjustable eccentric pivot screw 62 secured to the side frame 44. Rotational adjustment of the screw 62 will move the right hand end of shaft 41 (as viewed in FIG. 2) toward or away form the type wheels 11.

A gear 63, similar to gear 55, is mounted on the left hand end of the shaft 51 and is entrained through an idler 64 free on shaft 57 with a gear 65 free on shaft 41 and provided with an eccentric 66, similar to eccentric 60, and rotatably mounted in a bearing member 166 similar to member 61.

Accordingly, during the early part of a printer cycle, the eccentrics 60 and 66 will be yieldably rotated to shift the platen roll 37 forwardly to engage the paper tape 31 and any slips within the paper chute 36 with the printing ribbon 29 and the type wheels 11.

FIG. 3 illustrates the platen shaft 41 in position partially advanced toward the type wheels 11 as a result of partial rotation of the eccentrics 60 and 61. the Concurrently with the above noted lateral movement of the platen roll 37, a gear 67 (see also FIG. 4) fixed on shaft 46 and entrained through an idler 68, free on shaft 57, with a gear 70 fixed on shaft 41, rotates the latter and the eccentrics 40, which form positive acting means, to further advance the platen roll 37 forwardly to cause a printing impression. It will be appreciated that the latter is a positive driving movement as compared to the yieldable rotational movement of the eccentrics 60 and 66. However, the latter eccentrics 60 and 66 are self-locking and can not be reversed by the reactive force exerted against them by the platen roller 37 during a continued positive imprintimg movement imparted to it by eh eccentrics 40.

The dot-dash line 37*a* in FIG. 1 illustrates a theoretical advanced position of the platen roll 37 resulting from 180° rotation of the platen shaft 41 and eccentrics 40 without accompanying rotation of the eccentrics 60 and 66. However, under normal conditions, the platen shaft 41 and eccentrics 40 are concurrently bodily shifted to the left by the yieldably driven eccentrics 60 and 66 until the platen roll 37 assumes a position, for example, as shown at 37*b* wherein the platen roll 37 causes the paper to engage the type wheels 11. Thereafter, the platen shaft 41 and eccentrics 40 will continue through their strokes to cause a positive printing impression.

From the above it will be seen that the printing impression is controlled automatically. In the case of a relatively thick stack of slips or papers within the paper chute 36, the platen roll 37 will engage the stack against the type wheels earlier in its advancement and therefore the positive printing motion obtained from the concurrent rotation of the eccentrics 40 has a larger amplitude which compensates for the compressibility of the larger stack to effect a proper printing impression. That is, some of such greater amount of movement of the platen rolls 37 by the eccentrics 40 is used to compress the larger stack of papers, resulting in a net impression movement which effects an optimum imprinting action. On the other hand, when the stack contains only one or two or no slips, the platen roll 37 is driven to a further extent by the eccentrics 60 and 61 before engaging such slips with the type wheels and, therefore, the continued positive printing motion effected by the eccentrics 40 will have less amplitude during the imprinting action, resulting in the same amount or intensity of printing imprint regardless of the number of slips or thickness of the stack of papers.

As the drive shaft 46 continues through its revolution, the gear train 67, 68 and 70 rotates the shaft 41 and eccentrics 40 on through to their home positions, i.e., one complete revolution, while a gear 71 (see also FIG. 6) having interrupted teeth thereon meshes with the smaller member of the compound gear 50 (FIGS. 6 and 7) to drive the latter counterclockwise and thus reverse the rotation of shaft 51 and gear train 55, 56, 58, etc., to return the eccentrics 60 and 66, and thus the platen roll 37, to their initial home positions where the platen roll 37 is spaced from the type wheels 11 to permit withdrawal or insertion of slips in the chute 36.

Means are provided to retract the paper tape 31 during the early stages of a printing cycle from a position wherein the last amount printed is visible to the operator to a printing position and to advance the tape during the latter stages of a printing cycle from its retracted position to a similar advanced position to again be viewed by the operator. For this purpose, a three toothed gear 75 (see also FIG. 8) is fastened on the drive shaft 46 and is effective to mesh with a gear 76 fastened on shaft 57 at the start of a printing cycle, thereby rotating the paper feed rollers 33 counterclockwise to retract the tape 31 three line spaces.

Toward the end of a printer cycle and after the printing operation, a second three toothed gear 77 (FIG. 9) meshes with an idler 78 free on shaft 51 and meshing with the gear 76 to drive the paper feed rollers 33 clockwise to advance the tape 31 through three line spaces to a position where the last printed amount is visible to the operator.

The paper tape 31 may be selectively fed one, two or no line spaces during each printer cycle under control of a variable feed line spacing line mechanism shown in FIGS. 2 and 10 to 14, inclusive. For this purpose, a gear member 80 (FIG. 11) is rotatably mounted on the shaft 51 and has a full set of gear teeth (FIG. 11) meshing with a full set of gear teeth 83 formed on a gear member 84 freely mounted on the drive shaft 46. Gear 84 has two additional diametrically opposed sets of two teeth 85 (FIG. 10) spaced lengthwise from gear teeth 83 and engageable with the aforementioned idler gear 78 on shaft 51.

A drive gear 86 (FIGS. 12 and 13) keyed on the drive shaft 46 has one set of interrupted gear teeth 87 thereon engageable with two sets of diametrically opposed interrupted gear teeth 88 formed on the aforementioned gear member 80 and another set of axially displaced interrupted gear teeth 90 engageable with a set of interrupted gear teeth 91 also on the gear member 80.

In addition, a detenting tooth section 92 (FIG. 14) and a ratchet tooth section 93 are formed on the gear member 80, the section 92 being engageable by a detent 94 and the ratchet tooth section 93 being engageable by a pawl 95. The latter is pivotally connected at 96 to the armature 97 of an electromagnet 98. The armature is pivoted at 100 and is normally held in its illustrated position by a spring 101 tensioned between the detent 92 and the pawl 95.

The gear member 80 is normally maintained in its illustrated "0" position wherein it will be ineffective to line space the paper tape 31, as will appear presently.

If, it is desired to advance the paper tape two line spaces during a printing cycle, the electromagnet 98 is pulsed twice prior to such cycle, causing pawl 95 to initially advance gear member 80 two increments in a counterclockwise direction. Accordingly, the tooth 102 (FIG. 12) of gear set 91 will be spaced in the path of the teeth 90 on gear 86. Also, gear 84 (FIG. 10) will be advanced clockwise two increments by gear number 80 to locate tooth 85*a* in its alternate dotted line position 85*a'* relative to gear 78. Now, during the latter part of the ensuing printer cycle, gear 86 will advance the gear 80 counterclockwise causing clockwise rotation of gear 84 to cause the now advanced gear teeth 85 on the latter to drive gear 78 which, as mentioned heretofore, meshes with gear 76 (FIG. 9) fixed on the shaft 57 carrying the paper feed rolls 33 (FIG. 2), to feed the paper tape two line spaces.

Subsequently, gear teeth 87 on gear 86 (FIG. 13) will engage and drive gear teeth 88 on gear member 80 to advance the latter through the remainder of a one-half revolution into its "0" position in readiness for the next cycle.

If, on the other hand, it is desired to feed the paper tape 31 one line space only during the succeeding printer cycle, the electromagnet 98 is pulsed once only, thereby advancing the gear member 80 once only to locate a tooth 103 thereon in the path of the gear teeth 90 of gear 86 and to locate gear tooth 85 on gear 84 in its dotted line position 85*a''*. During subsequent rotation of the gear 86, gear member 80 will be moved one increment less than previously, resulting in the paper feed rollers 33 imparting one line space only to the paper tape. Later, gear teeth 87 on gear 86 will advance the gear member 80 through the remainder of its one-half revolution to return the same to its initial illustrated position.

When it is desired not to line space the paper tape during a printing cycle, the electromagnet 98 is not pulsed and the gear member 80 is left in its initial position, in which case the teeth 85 of gear 84 are directly aligned with the teeth of gear 77 (FIG. 9). Accordingly, the gear 85 will be ineffective to advance gear 78, and therefore the paper feed rollers 33, beyond their normal roll-forward advancement by gear 77 as described previously.

If it is desired to selectively omit printing in certain denominational orders, one of the type characters 13 on each of the type wheels 11 of such orders may be removed by cutting off the same along the dotted line 105 (FIG. 1).

I claim:

1. A data printer comprising type members, type characters on said members, means for differentially setting said type members to position different ones of said type characters at a printing station, a printing platen, means for guiding a record medium intermediate said type members and said platen, cam means for advancing said platen towards said type members a first distance, yieldable drive means for actuating said cam means to advance said platen toward said type members to engage said record medium, and positively driven means intermediate said cam means and said platen for advancing said platen toward said type members a second distance in addition to said first distance, and relative to said cam means, the advancement of said platen through said first and second distances causing a printing impression of said record medium against said type characters at said printing station.

2. A data printer as defined in claim 1 including means rendering said cam means self-locking whereby to prevent said positive acting means from retracting said cam means.

3. A data printer as defined in claim 1 wherein said positive acting means comprises a second cam means.

4. A data printer as defined in claim 1 wherein said cam means and said positive acting means comprise rotatable eccentrics.

5. A data printer comprising type members, type characters on said members, means for differentially setting said type members to position different ones of said type characters at a printing station, a rotatable printing platen, means for supporting a record medium intermediate said type members and said platen, means comprising an eccentric rotatably supporting said platen for free rotation, means for guiding said eccentric in a linear path toward and away from type members, means other than said eccentric for moving said eccentric a first distance along said linear path, and means for positively rotating said eccentric about an axis eccentric to the axis of rotation of said platen whereby to cause said platen to move a second distance toward said type members to cause a printing impression of said record medium against said type characters at said printing station.

6. A data printer as defined in claim 5 wherein said eccentric rotating means and said eccentric moving means operate concurrently.

7. A data printer as defined in claim 5 comprising means for guiding said eccentric in a linear path toward and away from said type members, means comprising a second eccentric for moving said first mentioned eccentric along said linear path;

yieldable means for rotating said second eccentric, said second eccentric being self-locking whereby to prevent said first mentioned eccentric from causing reverse movement of said second eccentric.

8. A data printer comprising type members, type characters on said members, means for differentially setting said type members to position different ones of said type characters at a printing station, a printing platen, means comprising a first eccentric connected to said platen, drive means for rotating said first eccentric to advance said platen towards said type members, means guiding said first eccentric and said platen for movement towards said type members, means comprising a second eccentric for moving said first eccentric and platen toward said type members, and yieldable drive means for rotating said second eccentric concurrently with said first mentioned drive means, said second eccentric being self-locking whereby to prevent said first eccentric from causing reverse movement of said eccentric.

9. A data printer comprising type members, type characters on said members, means for differentially setting said type members to position different ones of said type characters at a printing station, a rotatable printing platen, means comprising an eccentric rotatably supporting platen for free rotation, means for rotating said eccentric about an axis eccentric to the axis of rotation of said platen whereby to cause said platen to roll over said record medium and said type characters to impress a type character on said record medium, means for guiding said first eccentric in a linear path towards said type members, means comprising a second eccentric for moving said first eccentric along said linear path, and yieldable drive means for rotating said second eccentric in one direction concurrently with said first rotating means, said yieldable means being effective after said printing impression to rotate said second eccentric to retract said platen from said type members.

* * * * *